US011986055B2

(12) United States Patent
Tseng et al.

(10) Patent No.: US 11,986,055 B2
(45) Date of Patent: May 21, 2024

(54) SHOE COVER

(71) Applicant: Inteplast Group Corporation, Livingston, NJ (US)

(72) Inventors: Pai-Mei Tseng, Somerset, NJ (US); Jyh-Yao Raphael Li, Parsippany, NJ (US)

(73) Assignee: INTEPLAST GROUP CORPORATION, Livingston, NJ (US)

( * ) Notice: Subject to any disclaimer, the term of this patent is extended or adjusted under 35 U.S.C. 154(b) by 0 days.

(21) Appl. No.: 17/935,749

(22) Filed: Sep. 27, 2022

(65) Prior Publication Data

US 2024/0099418 A1 Mar. 28, 2024

(51) Int. Cl.

| | |
|---|---|
| ***A43B 3/16*** | (2022.01) |
| ***A43B 3/18*** | (2022.01) |
| *A43B 1/14* | (2006.01) |

(52) U.S. Cl.

CPC ..... *A43B 3/18* (2013.01); *A43B 1/14* (2013.01); *A43B 3/163* (2013.01)

(58) Field of Classification Search

CPC .. A43B 3/163; A43B 3/14; A43B 7/00; Y10T 24/45162; B65D 33/2541

See application file for complete search history.

(56) References Cited

U.S. PATENT DOCUMENTS 3,283,422 A * 11/1966 Nygard ..... A43B 3/163 206/820
3,337,770 A * 8/1967 Saraceni ..... A43B 3/163 36/7.1 R
3,402,323 A * 9/1968 Longstreth ..... A43B 3/163 36/7.1 R
4,272,859 A * 6/1981 Vanhove ..... A43B 3/163 36/7.1 R
4,304,021 A * 12/1981 Theodorsen ..... A43B 3/16 12/1 A
4,335,527 A * 6/1982 Pask ..... A43B 3/163 36/7.1 R
4,616,429 A * 10/1986 Alcala ..... A43B 3/163 36/8.3
4,677,697 A * 7/1987 Hayes ..... A41D 19/0068 206/390

(Continued)

FOREIGN PATENT DOCUMENTS

| | | |
|---|---|---|
| CN | 101697843 A | 4/2010 |
| CN | 103478979 A | 1/2014 |
| CN | 207100671 U | 3/2018 |

*Primary Examiner* — Jillian K Pierorazio
(74) *Attorney, Agent, or Firm* — Stinson LLP

(57) ABSTRACT

A pair of separable shoe covers formed into a web of polymeric material having an outer and inner sheet portions is disclosed herein. The web may be spooled into a roll of separable shoe covers. First and second seals are formed widthwise across the outer and inner sheet portions and form forward and rearward portions of respective shoes of a pair. First and second perforations are formed widthwise across the outer and inner sheet portions can separate an individual shoe cover in part. A third perforation forms a separable boundary of respective shoe covers of the pair. The user may tear a shoe cover away from the web by tearing along the perforation lines. The user may then deploy the shoe cover by separating the outer and inner sheet portions.

17 Claims, 6 Drawing Sheets

(56) References Cited

U.S. PATENT DOCUMENTS 4,847,934 A * 7/1989 Weber ..... B29C 66/43 36/7.1 R
5,025,503 A * 6/1991 O'Brien ..... A41D 19/0068 206/390
5,238,306 A * 8/1993 Heintz ..... B65D 33/2541 493/962
5,584,218 A * 12/1996 Schoendienst ..... B26D 7/2614 83/695
5,878,468 A 3/1999 Tomic et al.
6,532,686 B2 * 3/2003 Gultekin ..... A43B 3/163 36/7.1 R
6,748,605 B1 * 6/2004 Brinkmann ..... A41D 19/0068 2/167
7,506,487 B2 3/2009 Eads et al.
10,124,933 B2 * 11/2018 Tseng ..... B65D 33/2508
10,604,305 B2 * 3/2020 Lin ..... B65D 33/34
11,116,276 B2 9/2021 Su et al.
2003/0138171 A1 * 7/2003 Kikuchi ..... B65D 33/007 383/63
2005/0126037 A1 * 6/2005 Benham ..... A43B 1/0063 36/4
2005/0251973 A1 * 11/2005 Sprehe ..... B65D 33/2541 24/399
2010/0142861 A1 * 6/2010 Sam ..... B65D 31/12 383/105
2010/0209020 A1 * 8/2010 Delasalle ..... B65D 33/2508 383/64
2011/0162329 A1 * 7/2011 So ..... B65D 33/2533 53/469
2012/0279941 A1 * 11/2012 Sprehe ..... B65D 25/16 215/11.3
2017/0015470 A1 * 1/2017 Tseng ..... B65D 33/002
2022/0386721 A1 * 12/2022 Tseng ..... A41D 19/0068

* cited by examiner

SHOE COVER

FIELD

The present disclosure generally relates to disposable plastic shoe covers.

BACKGROUND

Shoe covers are widely used in situations where it is desirable prevent depositing material (e.g., dirt) on a person's shoes onto flooring, and depositing material from the floor onto the person's shoes. Typically, shoe covers are made from plastic sheet material that is formed roughly into a shape that accommodates a person's foot or shoe. Usually the shoe covers come in one size or only a very few sizes, making it difficult to properly fit a range of shoe sizes. To alleviate that problem shoe covers often have elastic material around the openings in the shoe covers into which the shoe or foot is inserted. The elastic material yieldably constricts the opening so that once the shoe or foot is inserted into the shoe cover, the elastic material pulls the shoe cover around the ankle so that the shoe cover is held onto the ankle. Manufacture of shoe covers including elastic material requires a distinct step of securing the elastic material to the plastic of the shoe cover. The elastic material must be accurately located with respect to the shoe cover opening. Moreover, storage of shoe covers prior to use is less efficient, because the covers do not lie flat when the elastic material is applied because the elastic material causes the plastic to bunch up around the opening.

SUMMARY

In one aspect of the present invention, a web of shoe covers comprises a first sheet member of polymeric material. A second sheet member of polymeric material generally underlying the first sheet member. The first and second sheet members having opposite longitudinal edges and being operatively connected to each other at the respective longitudinal edges. The first and second sheet members having a length parallel to the longitudinal edges and a width transverse to the longitudinal edges that is less than the length of the first and second sheet members. A first line of weakness extending between the longitudinal edges of the first and second sheet members at a first location. The first line of weakness being constructed to promote tearing of the first and second sheet members along the first line of weakness. A second line of weakness extending between the longitudinal edges of the first and second sheet members at a second location, the second line of weakness being constructed to promote tearing of the first and second sheet members along the second line of weakness. A first shoe cover defined between the first line of weakness and the second line of weakness adjacent to a first of the opposite longitudinal edges of the first and second sheet members. A second shoe cover defined between the first line of weakness and the second line of weakness adjacent to a second of the opposite longitudinal edges of the first and second sheet members.

In another aspect, a web of shoe covers comprises a first sheet member of polymeric material. A second sheet member of polymeric material generally underlies the first sheet member. The first and second sheet members have opposite longitudinal edges and are operatively connected to each other at the respective longitudinal edges. The first and second sheet members have a length parallel to the longitudinal edges and a width transverse to the longitudinal edges that is less than the length of the first and second sheet members. A first line of weakness extending between the longitudinal edges of the first and second sheet members at a first location, the first line of weakness being constructed to promote tearing of the first and second sheet members along the first line of weakness. A second line of weakness extending between the longitudinal edges of the first and second sheet members at a second location, the second line of weakness being constructed to promote tearing of the first and second sheet members along the second line of weakness. A first shoe cover defined between the first line of weakness and the second line of weakness. A second shoe cover defined between the first line of weakness and the second line of weakness. A zipper integrated into the first and second sheet members and arranged for adjusting the size of a foot opening into the first shoe cover when the first shoe cover is separated from the second shoe cover. The zipper being further arranged for adjusting the size of a foot opening into the second shoe cover when the second shoe cover is separated from the first shoe cover.

In yet another aspect, a web of shoe covers comprises a first sheet member of polymeric material. A second sheet member of polymeric material generally underlies the first sheet member. The first and second sheet members have opposite longitudinal edges, lengths length parallel to the longitudinal edges and widths transverse to the longitudinal edges that is less than the length of the first and second sheet members. A first gusset disposed between the first and second sheet members adjacent one of the longitudinal edges of the first and second sheet members. The first gusset interconnecting the first and second sheet members at said one longitudinal edge. A second gusset disposed between the first and second sheet members adjacent the other of the longitudinal edges of the first and second sheet members. The second gusset interconnecting the first and second sheet members at said other longitudinal edge. A first line of weakness extending between the longitudinal edges of the first and second sheet members at a first location. The first line of weakness being constructed to promote tearing of the first and second sheet members along the first line of weakness. A second line of weakness extending between the longitudinal edges of the first and second sheet members at a second location. The second line of weakness being constructed to promote tearing of the first and second sheet members along the second line of weakness. A first shoe cover defined between the first line of weakness and the second line of weakness. A second shoe cover defined between the first line of weakness and the second line of weakness and separable from the first shoe cover. The first gusset being arranged to form a bottom of the first shoe cover when the first show cover is separated from the second shoe cover. The second gusset being arranged to form a bottom of the second shoe cover when the second shoe cover is separated from the first shoe cover.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
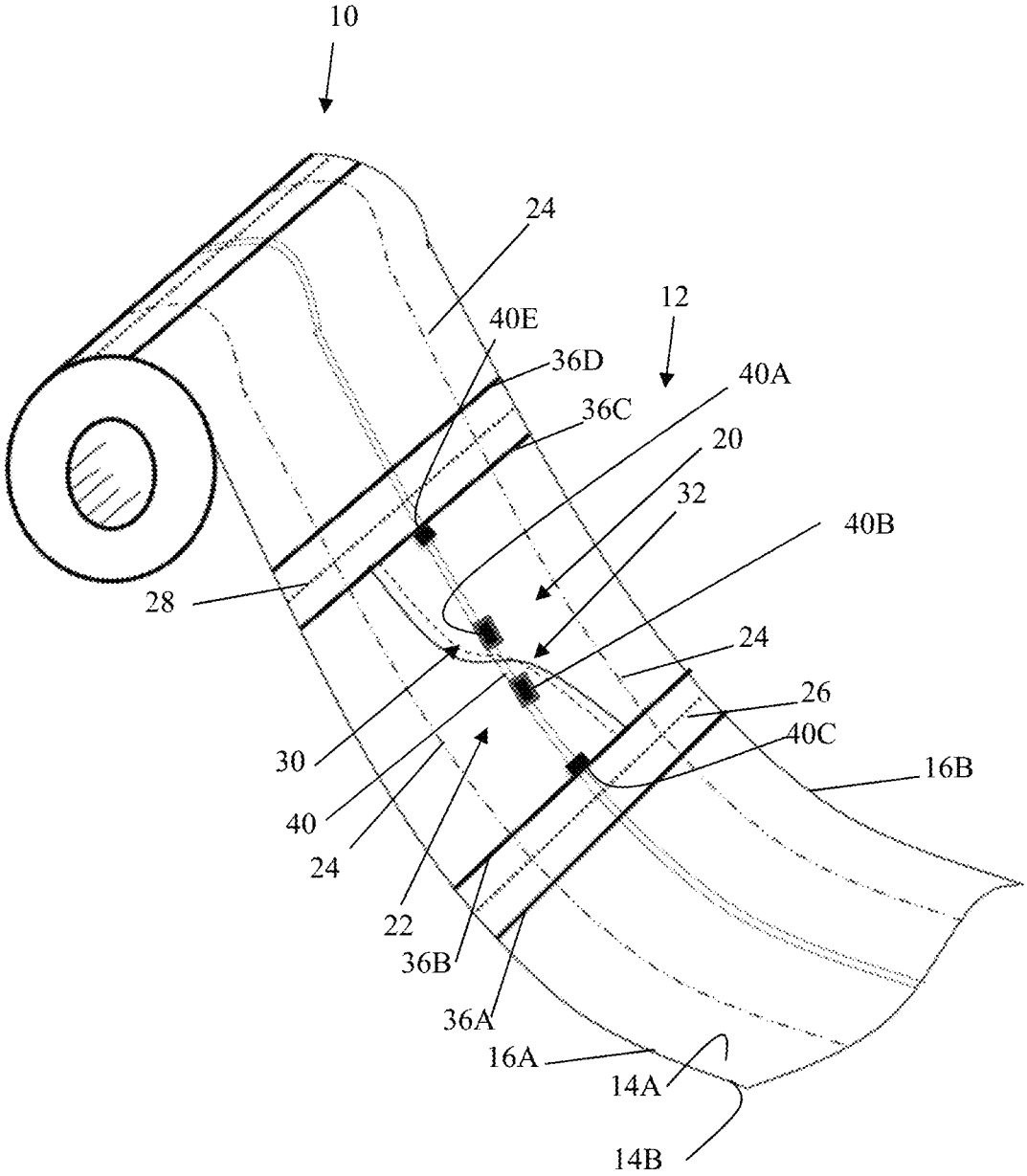
FIG. 1 is a schematic perspective of a roll of shoe covers.

Referring now to the drawings and in particular to FIG. 1, a roll of shoe covers 10 can feed out into a web including pairs of shoe covers 20,22 that can be torn away from the web. The shoe covers can be slipped over a person's shoes to provide temporary protection of flooring from mud and debris on the shoes, and/or protect the shoes from becoming contaminated with something on the floor. It will be understood that although the articles are referred to a "shoe" covers, this does not mean that the covers must receive a shoe. A shoe cover can be worn over stocking or bare feet and still be considered a "shoe cover" for all purposes in this document. The web as it exists within the roll can lie generally flat against an adjacent turn of the roll. In this way the roll can be compact and hold a number of shoe covers in a relatively small space. Although dispensing from a roll is highly desirable, the web could be stored in other ways within the scope of the present invention.

The web of shoe covers includes a first sheet member 14A of polymeric material and a second sheet member 14B of polymeric material underlying the first sheet member. As they are situated in the web, the first and second sheet members 14A,14B include opposite longitudinal edges 16A, 16B, that overlie each other. The first and second sheet members having a length parallel to the longitudinal edges and a width transverse to the longitudinal edges. The length of the first and second sheet members is very much greater than the width over the entire roll. In the illustrated embodiment, the first and second sheet members are connected to each other at the overlying longitudinal edges 16A, 16B by respective gussets 24A, 24B. In the web illustrated in the drawings, each gusset 24A, 24B is folded in half and resides between the first and second sheet members 14A, 14B adjacent a respective longitudinal edge of the first and second sheet members. However, it will be understood that the gussets 24A, 24B could be eliminated and the longitudinal edges could be directly connected together. In one embodiment, the web 12 can be formed initially as a seamless tube in a blown film process. In some embodiments, the web is formed from a blown film extrusion of polyethylene, polypropylene or other compatible polyolefins or blends (broadly, "polymeric materials"). In still other embodiments, the web may be coextruded with a higher friction formulation and/or embossed to increase the coefficient of friction and improve the grip of the shoe cover with the floor. An example of a higher friction formulation can be found in co-assigned U.S. Pat. No. 10,065,768, the disclosure of which is incorporated herein in its entirety. In some embodiments, the higher friction achieved by co-extrusion with a higher friction formulation and/or embossment would be confined to the region of the gussets. The gussets would be formed by folding in side portions of the tube and the tube would be collapsed into a flattened state (as shown in the drawings). However, other ways of forming the web can be used.

Figure 2:
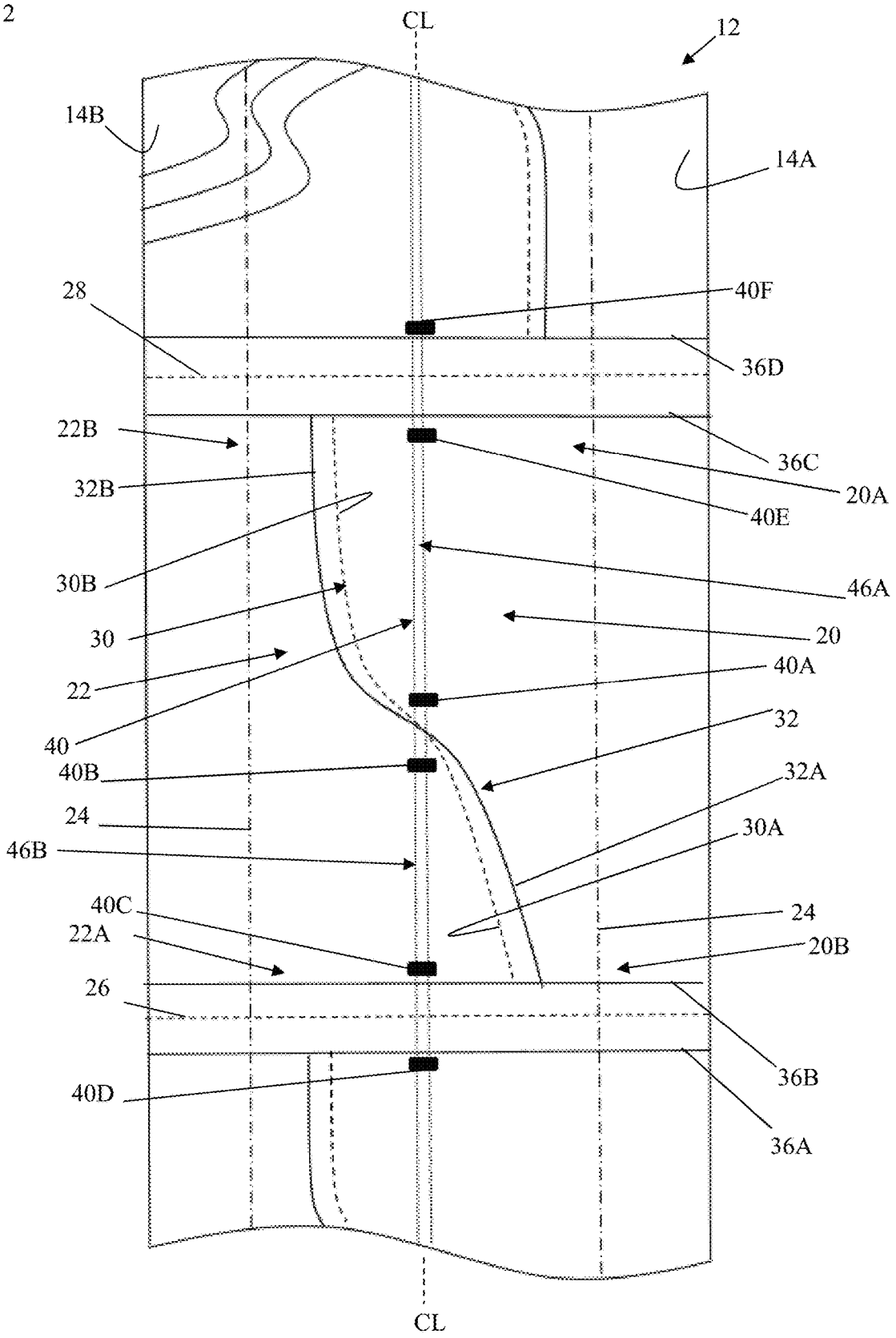
FIG. 2 is a fragmentary top plan view of a portion of a web of shoe covers fed out from the roll.

As shown in FIG. 2, the web 12 comprises a first line of weakness in the form of a first perforation line 26. A second line of weakness in the form of a second perforation line 28 is spaced lengthwise of the web from the first perforation line. The first and second perforation lines 26, 28 define the lengthwise boundaries of a pair of the shoe covers 20, 22. The shoe covers 20, 22 are arranged side-by-side across the width of the web 12. A third line of weakness in the form of a third perforation line 30 marks the boundary between the first and second shoe covers 20, 22 and allows for separation of the shoe covers from each other. Thus, the first and second shoe covers 20, 22 of the pair are defined between the first perforation line 26 and the second perforation line 28. Further, the first and second shoe covers are defined by the third perforation line 30, which forms a boundary between and separates the first and second shoe covers 20, 22 from each other generally along the length of the web. In the illustrated embodiment, the web has an imaginary longitudinal centerline CL. As the third perforation line 30 extends from near the first perforation line to near the second perforation line, a first segment 30A of the third perforation line 30 is located on one side of the longitudinal centerline CL and a second segment 30B of the third perforation line 30 is located on an opposite side of the longitudinal centerline. Only one pair of shoe covers is shown in the drawings, however, the web contains a multiplicity of shoe cover pairs, all of the same construction as the illustrated shoe cover pair, positioned one after the other along the length of the web.

Figure 5:
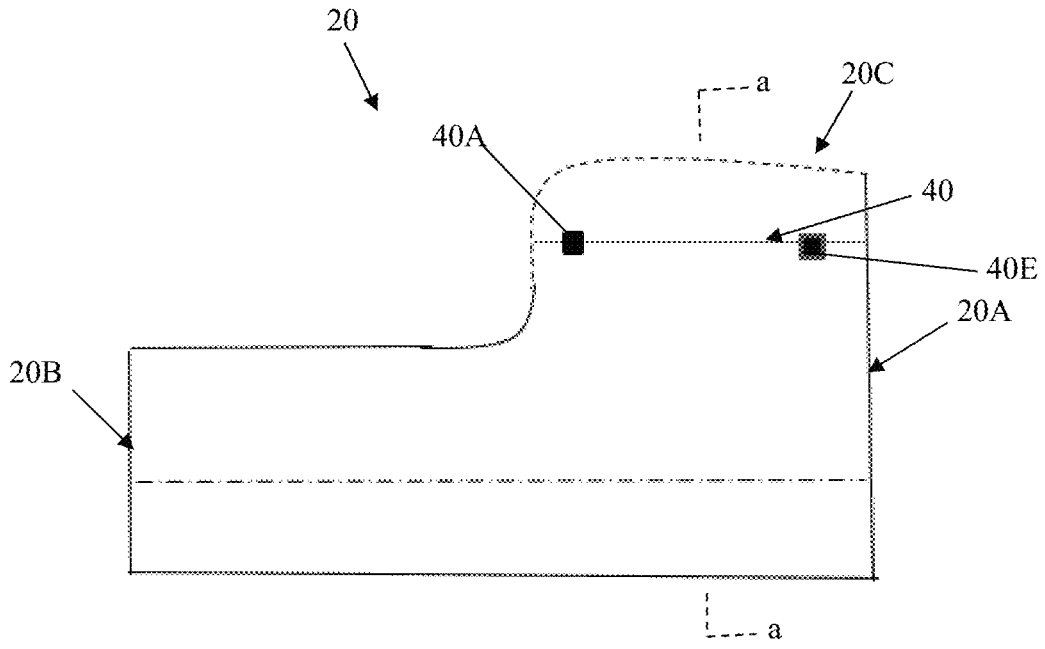
FIG. 5 is an enlarged top plan view of an individual shoe portion.
Figure 6:
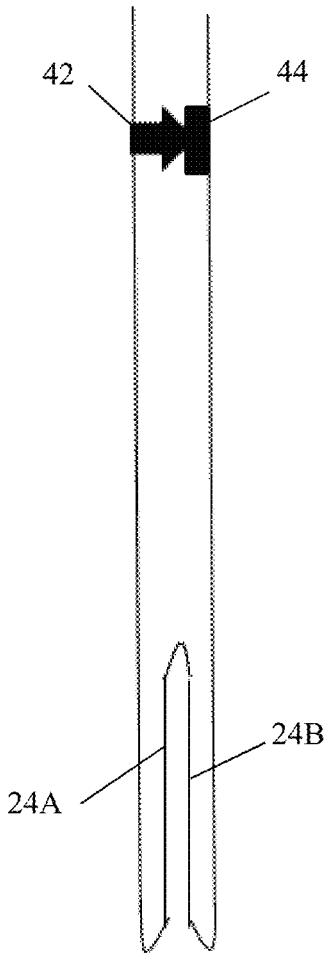
FIG. 6 is a cross-section a-a of FIG. 5

An upper seal 32 connecting the first sheet member to the second sheet member extends generally between the first perforation line 26 and the second perforation line 28. The term "upper" is used because the seal is ultimately associated with portions of the first and second shoe covers 20,22 that cover the upper of a shoe received in the cover. More particularly, the upper seal 32 extends between a second transverse seal 36B and a third transverse seal 36C described hereinafter. Similar to the third perforation line, the upper seal 32 includes a first segment 32A on one side of the longitudinal centerline CL of the web and a second segment 32B on the opposite side of the longitudinal centerline. Each of the first and second segments 30A, 30B of the third perforation line 30 lies closer to the longitudinal centerline CL of the web than the corresponding first and second segment 32A, 32B of the upper seal 32. As a result of this configuration, the first segment 32A of the upper seal 32 closes a forward portion of the first shoe cover 20 even after the third perforation line 30 is torn to separate the first and second shoe covers 20, 22. The second segment 32B of the upper seal 32 closes a forward portion of the second shoe cover 22 after separation from the first shoe cover 20. The first segment 30A of the third perforation line 30 forms an opening (not shown) in the second shoe cover 22. The second segment 30B of the third perforation line 30 forms an opening 20C (see FIG. 5) into the first shoe cover 20. In order to be in the proper positions, the third perforation line 30 crosses over the upper seal 32 where they both intersect the centerline CL of the web. Other locations for the crossover could be used, but in this case the construction facilitates forming the first and second shoe covers having the same size and shape.

The first and second perforation lines 26, 28 are made up of perforations that extend through the first and second sheet members and also through the gussets, where the perforation lines extend across the gusset. Other ways of preferentially weakening the material of the web for directed tearing besides perforating may be used. First and second transverse seals 36A, 36B extend widthwise of the web in close proximity to, but on opposite sides of the first perforation line 26. Similarly, a third transverse seal 36C and a fourth transverse seal 36D extend widthwise of the web in close proximity to, but on opposite sides of the second perforation line 28. Each of the first and second transverse seals 36A, 36B joins together the first sheet member 14A, the second sheet member 14B and the folded halves of the gussets 24A, 24B between the first and second sheet members. As a result of this construction, when the first and second perforation lines 26, 28 are torn, the second transverse seal 36B holds a toe portion 20B of the first shoe cover 20 and a heel or back portion 22A of the second shoe cover 22 closed. Likewise, the third transverse seal 36C holds a heel or back portion 20A of the first shoe cover 20 and a toe portion 22B of the second shoe cover 22 closed.

Figure 4:
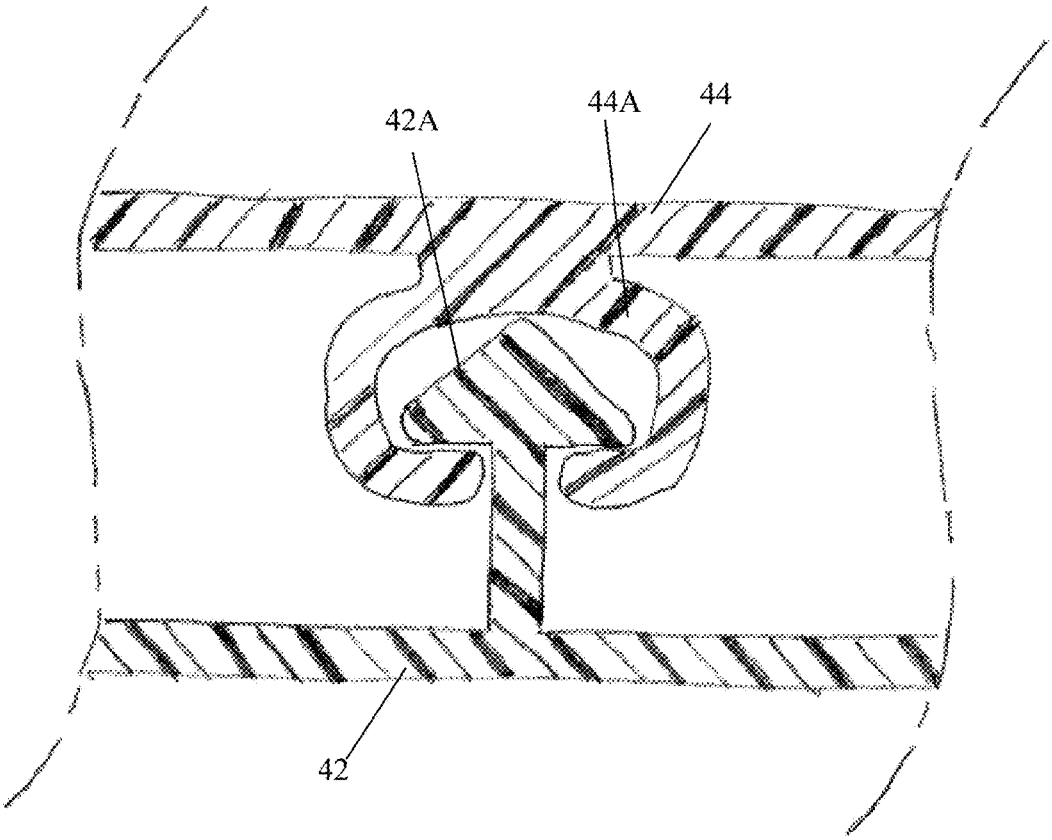
FIG. 4 is an enlarged, fragmentary cross section of the web showing mating elements of a zipper.

The web further includes a zipper 40 that extends along the length of the web. In the illustrated embodiment, the zipper 40 extends continuously along the length of the web. Referring to FIG. 4, the zipper includes a male 42 (first) zipper element and a female 44 (second) zipper element. In some embodiments, the male and female zipper elements 42, 44 can be co-extruded with the first and second sheet members of the web, respectively. The zipper elements could be formed separately and attached to the first and second sheet members. In either case, the zipper elements are ultimately integrated into the first and second sheet members. The male zipper element 42 can be inserted into the female zipper element 44 to connect the first and second sheet members together. The material and construction of the male and female zipper elements is selected so that the elements will remain connected in use, even if other sections of the male and female zipper elements are unconnected. In the illustrated embodiment, the zipper extends coincident with the longitudinal centerline CL, although other arrangements are possible. Referring to FIG. 4, it may be seen that the male zipper element 42 includes an arrow-shaped head 42A and that the female zipper element 44 if formed by a channel-shaped member 44A. The arrow-shaped head 42A is wider than the opening of the channel-shaped member 44A. The wedge configuration of the head 42A allows the male zipper element to force the opening of the channel-shaped member 44A of the female zipper element to widen so that the male zipper element can be received within the female zipper element. The female zipper element 44 is resilient so that the channel-shaped member 44A springs back to substantially enclose the head 42A of the male zipper element 42, which is the configuration depicted in FIG. 4. A significant force is required to release the male zipper element 42 from the female zipper element 44. In this way the zipper 40 can be used to partially close the openings in the first and second shoe covers (e.g., opening 20C in the first shoe cover 20) so that the shoe cover fits securely around the wearer's ankle and will not easily fall off.

Figure 3:
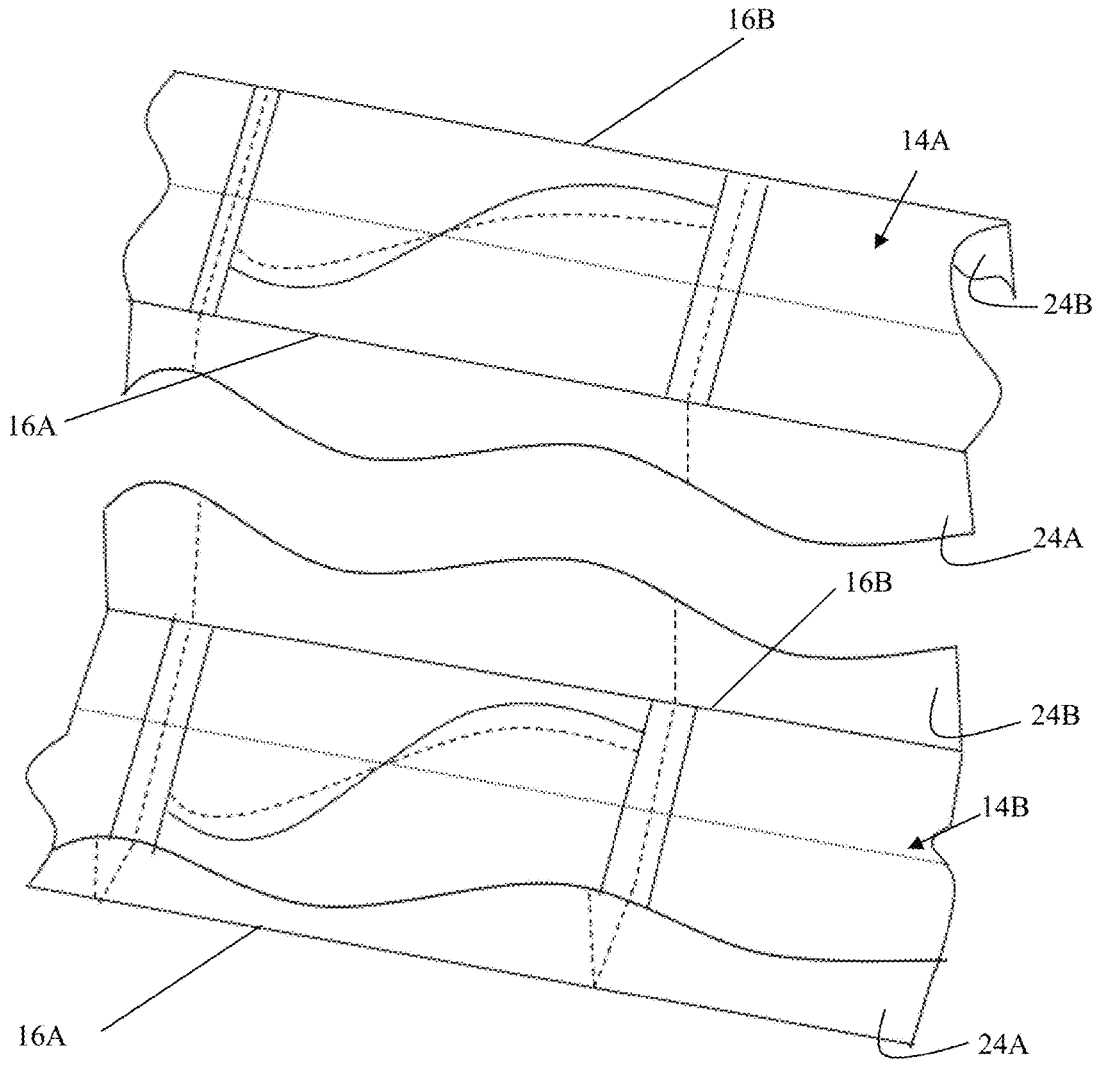
FIG. 3 is an exploded perspective of the fragmentary portion of the web.

It will be understood that other forms of zippers (not shown) can be used within the scope of the present invention. For example, the zipper may comprise two or more male and female zipper elements. In addition, the composition and construction of the zipper can be controlled in known ways in order to achieve an increased amount of force required to release the male and female zipper elements. It will be understood that as disposed about the ankle and remaining partially open, forces can be applied during ordinary walking and foot movement that might tend to pry the male and female zipper elements apart. Accordingly, it is desirable to have a more aggressive connection of the male and female zipper elements. The zipper could also have other forms, such as including male features (e.g., the arrow-shaped head) and female features (the channel-shaped member) at intermittent (spaced-apart) locations along the length of the web. An example of such an intermittent zipper is shown in FIGS. 3 and 7 of U.S. Pat. No. 5,878,468. The disclosure of U.S. Pat. No. 5,878,468 is incorporated herein by reference in its entirety. A zipper of this construction is believed to retard propagation of a zipper separation and some location under a force that may act along a side of the zipper. The zipper can also inhibit interlock blockage of the zipper.

The zipper 40 is traversed by the first through fourth transverse seals 36A, 36B, 36C, 36D. Each of the first through fourth seals joins the male and female zipper elements 42, 44 together. However, two additional outer zipper seals 40C, 40D are provided adjacent to each of the first and second transverse seals 36A, 36B, and zipper seals 40E, 40F are adjacent the third and fourth transverse seals 36C, 36D. Two of the outer zipper seals 40C, 40D are each located next to one of the first and second transverse seals 36A, 36B. These two outer zipper seals are each placed on an opposite side of the first or second transverse seal from the side to which the first perforation line 26 is located. The other two of the outer zipper seals 40E, 40F are each located next to one of the third and fourth transverse seals 36C, 36D. These two outer zipper seals 40E, 40F are each placed on an opposite side of the third of fourth transverse seal from the second perforation line 28. The first and second perforation lines 26, 28 also cross over the zipper 40 to separate the zipper (along with a pair of shoe covers) from the remainder of the web.

The zipper 40 is also traversed by the upper seal 32 and the third perforation line 30. The third perforation line 30 allows the zipper to be separated into distinct zipper units 46A, 46B (or "first and second portions"), one associated with the first shoe cover 20 and the other associated with the second shoe cover 22. The second segment 30B of the third perforation line 30 is located above the zipper unit 46A in the first shoe cover 20, in the orientation of the first shoe cover when worn. This arrangement allows a portion of the shoe cover between the zipper unit and the edge of the opening in the first shoe cover 20 to be grasped to open the first shoe cover opening 20C and to provide a grip for separating the male and female zipper elements 42, 44 to accomplish the opening. The same arrangement exists for the second shoe cover 22 in that the first segment 30A of the third perforation line 30 is located above the zipper unit 46B associated with the second shoe cover 22 when the second shoe cover is worn, and provides the same functionality. Inner zipper seals 40A, 40B are located adjacent to the location where the third perforation line 30 crosses over the upper seal 32. The location where the third perforation line 30 and zipper seal cross over each other is located between the two inner zipper seals 40A, 40B. In this way the inner zipper seals 40A, 40E and 40C, 40B form endpoints of the zipper units 46A, 46B and provide a robust and permanent connection and termination of the male and female zipper elements at one end of the opening for each respective shoe cover.

As previously described herein, the web includes gussets 24A,24B which are folded in half and lie between the first sheet member and the second sheet member, as indicated by gusset lines 24. Each of the gussets is located along a longitudinal edge 16A or 16B of the web. When the first and second shoe covers 20, 22 are separated from the web and from each other, the gussets 24A, 24B can be expanded to provide a relatively wide and flat bottom of the corresponding shoe cover. In this way the gussets 24A, 24B allow for the shoe covers 20, 22 to have a width dimension sufficient to receive the widths of shoes that will be covered using the shoe covers, while permitting the first and second shoe covers to be incorporated into a flat web suitable for being rolled into a compact roll. It will be understood that the gusset may take on other forms or even be eliminated within the scope of the present invention.

As various changes could be made in the above products and methods without departing from the scope of the disclosure, it is intended that all matter contained in the above description shall be interpreted as illustrative and not in a limiting sense.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

What is claimed is:

1. A web of shoe covers comprising:

a first sheet member of polymeric material;

a second sheet member of polymeric material generally underlying the first sheet member, the first and second sheet members having opposite longitudinal edges and being operatively connected to each other at the respective longitudinal edges, the first and second sheet members having a length parallel to the longitudinal edges and a width transverse to the longitudinal edges that is less than the length of the first and second sheet members;

a first line of weakness extending between the longitudinal edges of the first and second sheet members at a first location, the first line of weakness being constructed to promote tearing of the first and second sheet members along the first line of weakness;

a second line of weakness extending between the longitudinal edges of the first and second sheet members at a second location, the second line of weakness being constructed to promote tearing of the first and second sheet members along the second line of weakness;

a first shoe cover defined between the first line of weakness and the second line of weakness adjacent to a first of the opposite longitudinal edges of the first and second sheet members;

a second shoe cover defined between the first line of weakness and the second line of weakness adjacent to a second of the opposite longitudinal edges of the first and second sheet members;

a third line of weakness extending between the first line of weakness and the second line of weakness, the third line of weakness defining a boundary between the first shoe cover and the second shoe cover;

an upper seal operatively connecting the first sheet member and the second sheet member, the upper seal extending generally between the first line of weakness and the second line of weakness, the upper seal and third line of weakness cross over each other between the first line of weakness and the second line of weakness.

2. The web of shoe covers as set forth in claim 1 wherein a first segment of the third line of weakness is located on one side of a longitudinal centerline of the first and second sheet members that extends parallel to the longitudinal edges, and a second segment of the third line of weakness is located on an opposite side of the longitudinal centerline.

3. The web of shoe covers as set forth in claim 2 wherein a first segment of the upper seal is located on one side of a longitudinal centerline of the first and second sheet members, and a second segment of the upper seal is located on an opposite side of the longitudinal centerline.

4. The web of shoe covers as set forth in claim 3 further comprising a zipper integrated into the first and second sheet members.

5. The web of shoe covers as set forth in claim 4 wherein the zipper includes a first zipper element associated with the first shoe cover and a second zipper element associated with the second shoe cover.

6. The web of shoe covers as set forth in claim 4 wherein the third line of weakness traverses the zipper.

7. The web of shoe covers as set forth in claim 4 wherein the first segment of the third line of weakness is located closer to the zipper than the first segment of the upper seal, and the second segment of the third line of weakness is located closer to the zipper than the second segment of the upper seal whereby the first segment of the third line of weakness is configured to form an opening into the second shoe cover and the second segment of the third line of weakness is configured to form an opening into the first shoe cover, and the first segment of the upper seal is configured to form an enclosure for a foot in the first shoe cover and the second segment of the upper seal is configured to form an enclosure for a foot in the second shoe cover.

8. The web of shoe covers as set forth in claim 1 further comprising a first gusset interconnecting the first sheet member and the second sheet member at one of the longitudinal edges and a second gusset interconnecting the first sheet member and the second sheet member at the other of the longitudinal edges.

9. The web of shoe covers as set forth in claim 8 wherein the first gusset is disposed between the first sheet member and the second sheet member and configured to form a bottom of the first shoe cover and the second gusset is disposed between the first sheet member and the second sheet member and configured to form a bottom of the second shoe cover.

10. The web of shoe covers as set for in claim 1 further comprising third, fourth and other shoe covers formed in the first and second sheet members, the shoe covers being arranged in pairs spaced apart along the length of the first and second sheet members, and wherein the first and second sheet members are wound into a roll.

11. A web of shoe covers comprising:

a first sheet member of polymeric material;

a second sheet member of polymeric material generally underlying the first sheet member, the first and second sheet members having opposite longitudinal edges and being operatively connected to each other at the respective longitudinal edges, the first and second sheet members having a length parallel to the longitudinal edges and a width transverse to the longitudinal edges that is less than the length of the first and second sheet members;

a first line of weakness extending between the longitudinal edges of the first and second sheet members at a first location, the first line of weakness being constructed to promote tearing of the first and second sheet members along the first line of weakness;

a second line of weakness extending between the longitudinal edges of the first and second sheet members at a second location, the second line of weakness being constructed to promote tearing of the first and second sheet members along the second line of weakness;

a first shoe cover defined between the first line of weakness and the second line of weakness;

a second shoe cover defined between the first line of weakness and the second line of weakness;

a zipper integrated into the first and second sheet members and arranged for adjusting the size of a foot opening into the first shoe cover when the first shoe cover is separated from the second shoe cover, the zipper being further arranged for adjusting the size of a foot opening into the second shoe cover when the second shoe cover is separated from the first shoe cover.

12. The web of shoe covers as set forth in claim 11 wherein the zipper comprises an elongate female element integrated into one of the first and second sheet members and extending lengthwise of the first and second sheet members, and an elongate male element integrated into the other of the first and second sheet members and extending lengthwise of the first and second sheet members.

13. The web of shoe covers as set forth in claim 12 further comprising a third line of weakness extending between the first line of weakness and the second line of weakness, the third line of weakness extending across the zipper.

14. The web of shoe covers as set forth in claim 13 wherein the zipper includes a first zipper element associated with the first shoe cover and a second zipper element associated with the second shoe cover.

15. The web of shoe covers as set forth in claim 14 wherein the first and second sheet members have a longitudinal centerline extending lengthwise of the first and second sheet members, the zipper being arranged along the longitudinal centerline.

16. The web of shoe covers as set forth in claim 13 wherein the third line of weakness includes a first segment associated with the first shoe cover and a second segment associated with the second foot cover, the first segment being spaced widthwise from the first zipper element and the second segment being spaced widthwise from the second zipper element.

17. A web of shoe covers comprising:

a first sheet member of polymeric material;

a second sheet member of polymeric material generally underlying the first sheet member, the first and second sheet members having opposite longitudinal edges and being operatively connected to each other at the respective longitudinal edges, the first and second sheet members having a length parallel to the longitudinal edges and a width transverse to the longitudinal edges that is less than the length of the first and second sheet members;

a first line of weakness extending between the longitudinal edges of the first and second sheet members at a first location, the first line of weakness being constructed to promote tearing of the first and second sheet members along the first line of weakness;

a second line of weakness extending between the longitudinal edges of the first and second sheet members at a second location, the second line of weakness being constructed to promote tearing of the first and second sheet members along the second line of weakness;

a first shoe cover defined between the first line of weakness and the second line of weakness;

a second shoe cover defined between the first line of weakness and the second line of weakness;

a zipper integrated into the first and second sheet members and arranged for adjusting the size of a foot opening into the first shoe cover when the first shoe cover is separated from the second shoe cover, the zipper being further arranged for adjusting the size of a foot opening into the second shoe cover when the second shoe cover is separated from the first shoe cover, the zipper includes a first zipper element associated with the first shoe cover and a second zipper element associated with the second shoe cover;

wherein the first and second sheet members have a longitudinal centerline extending lengthwise of the first and second sheet members, the zipper being arranged along the longitudinal centerline.

* * * * *